US006866072B2

(12) United States Patent
Kaye

(10) Patent No.: US 6,866,072 B2
(45) Date of Patent: Mar. 15, 2005

(54) EFFLUENT DISPOSAL SYSTEM FOR RAILWAYS

(75) Inventor: Nicholas John Kaye, Chelmsford (GB)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/399,555

(22) PCT Filed: Nov. 1, 2001

(86) PCT No.: PCT/GB01/04834

§ 371 (c)(1),
(2), (4) Date: Apr. 17, 2003

(87) PCT Pub. No.: WO02/36406

PCT Pub. Date: May 10, 2002

(65) Prior Publication Data

US 2004/0020401 A1 Feb. 5, 2004

(30) Foreign Application Priority Data

Nov. 3, 2000 (GB) ..... 0026850

(51) Int. Cl.[7] ..... B65B 1/04
(52) U.S. Cl. ..... 141/65; 141/231; 4/323
(58) Field of Search ..... 141/65, 98, 231, 141/232; 4/321, 323, 342, 431

(56) References Cited

U.S. PATENT DOCUMENTS

| | | | | | |
|---|---|---|---|---|---|
| 957,933 | A | * | 5/1910 | Clarke | 4/323 |
| 1,030,782 | A | * | 6/1912 | Johnson et al. | 4/323 |
| 1,619,369 | A | | 3/1927 | Riegel | |
| 1,627,475 | A | | 5/1927 | Barbour | |

FOREIGN PATENT DOCUMENTS

| | | |
|---|---|---|
| GB | 1546875 | 5/1979 |
| GB | 2 342 663 A | 4/2000 |

* cited by examiner

*Primary Examiner*—Steven O. Douglas
(74) *Attorney, Agent, or Firm*—Kirschstein, et al.

(57) ABSTRACT

An effluent disposal apparatus for railways includes a storage tank adapted to be fitted to a railway vehicle. The tank has an inlet for receiving effluent, an outlet for release of the effluent stored in the tank, and an effluent release valve movable between a closed position in which the effluent is prevented from passing through the outlet, and an open position in which the effluent is allowed to pass through the outlet. A controller controls operation of the valve in response to an effluent release signal generated by a release signal generator to automatically open the release valve to release the effluent from the tank when the vehicle is at a predetermined position with respect to an effluent receptacle located under or alongside the track.

18 Claims, 1 Drawing Sheet

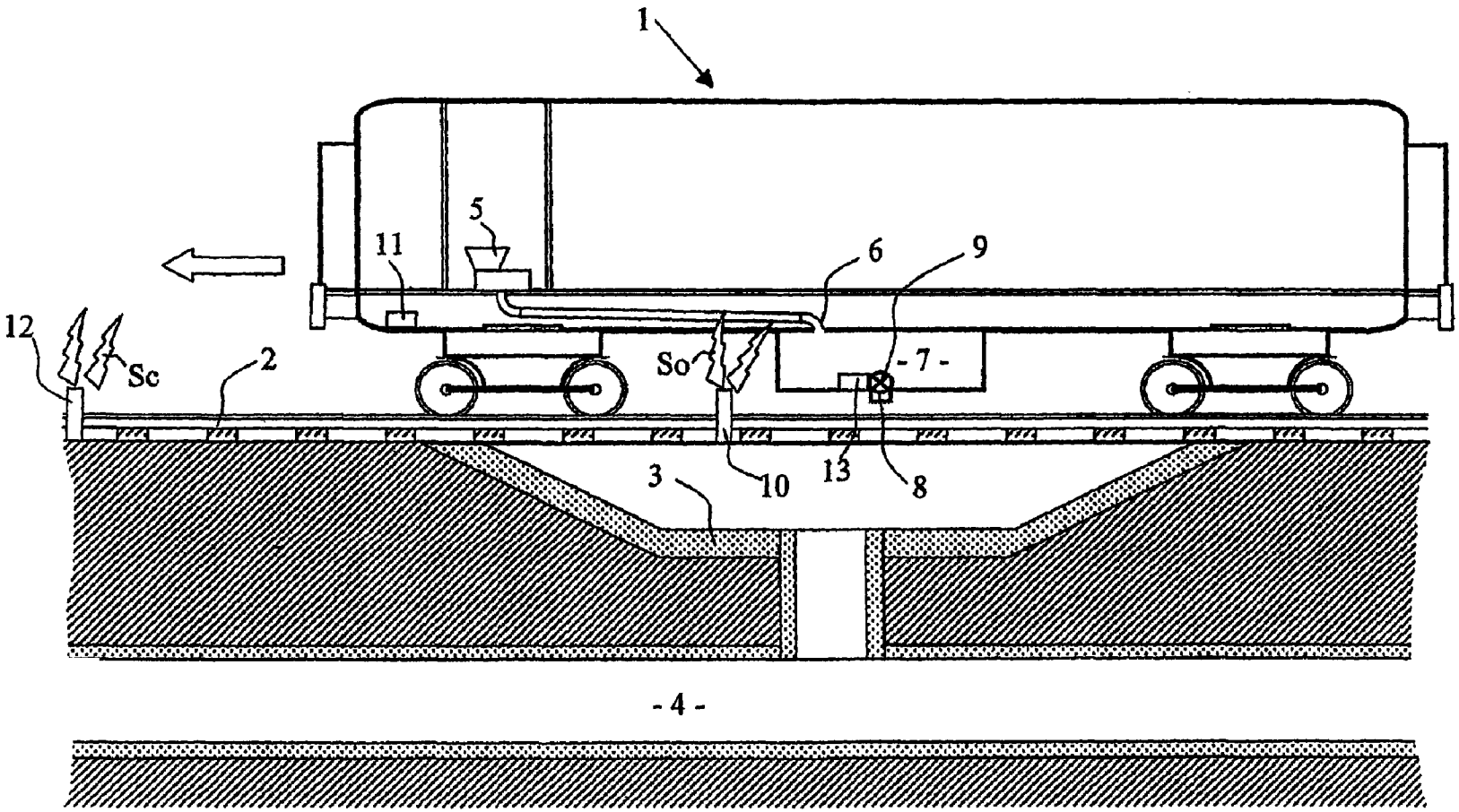
1
2
3
5
6
7
8
9
10
11
12
13
So
Sc

EFFLUENT DISPOSAL SYSTEM FOR RAILWAYS

This invention relates to improvements in railways, and, in particular, to an improved effluent disposal system or apparatus for rail vehicles.

It is at present known to provide WCs (toilets) or hand basins on railway vehicles such as passenger carriages and as such a method for removal of the effluent is needed. At present, two arrangements for the disposal of effluent are used.

Effluent from the WC or hand basin can be released directly from the underside of the vehicle onto the tracks where is it dispersed. With increasing pressures from environmental groups it is becoming socially unacceptable to release effluent in this way, not least because it contaminates the underside of the vehicle making routine maintenance work unpleasant, and in some cases, hazardous.

In a more refined system, it is known to provide a small storage tank on the vehicle which receives and stores effluent as the train facilities are used. At regular intervals, the train can be stopped to permit a vacuum pump to be manually attached to an outlet pipe that is connected to the tank. The vacuum pump draws the effluent from the tank along a flexible hose, and passes the effluent on to the mains sewer. It is then disconnected from the tank to allow the train to move away.

Whilst the latter system is more hygienic, it is quite time consuming to vacuum effluent from the tanks of a train comprising multiple carriages. A trained operator is also required to connect the hoses to the tanks, and disconnect the hoses. During this period, the train must be kept stationary. In general, connecting the hoses and draining the tank in this way can delay a vehicle for 10 minutes or more for each tank.

An object of the present invention is to ameliorate some of the problems posed by prior art effluent disposal systems for railways.

In accordance with the first aspect, the invention provides an effluent disposal system for a railway comprising:

- an effluent receptacle situated underneath or immediately alongside a length of railway track,
- an effluent storage tank fitted to a rail vehicle, the storage tank having an inlet for receiving effluent and an outlet for release of the effluent stored in the tank;
- outlet valve means operable between a closed position in which effluent is prevented from passing through the outlet, and an open position in which effluent is allowed to pass through the outlet;
- valve control means for controlling operation of the valve, the valve control means being responsive to receipt of an effluent release signal to effect opening of the outlet valve; and
- a release signal generating means for communicating the effluent release signal to the valve control means when the vehicle is at a pre-determined effluent release position with respect to the effluent receptacle.

The invention therefore provides for a system in which the effluent is normally held in the tank until the train is at pre-set point on a track, whereupon the valve control means receives a signal that releases the effluent. This eliminates the need for an operator to manually connect a pipe to the tank, and prevents effluent being released onto the tracks accidentally during use of the vehicle.

The release signal generating means preferably comprises a release signal transmitter located at a pre-determined position along the track and a release signal detector located at a pre-determined position on the vehicle. The transmitter may be, for example, a low-power, narrow-beam radio frequency or microwave frequency generator, or another type of transmitter of electromagnetic radiation, such as an infrared L.E.D. or a laser diode. Correspondingly, the detector mounted on the vehicle will be adapted to detect the radiation emitted by the transmitter, so may be a radio or microwave signal detection circuit, or a light beam detector. To prevent chance operation of the release valve by other electromagnetic radiation sources, the signal transmitted by the trackside transmitter may be coded in one of the well-known ways utilised, for example, in automobile remote locking and alarm systems, the detector or the valve control means being equipped with the appropriate decoding circuits so that the release valve only operates when the correct coded signal is detected.

As a simpler alternative, the release signal generating means may comprise a button or lever or other switching device mounted on the train, whereby manual actuation of the switching device by a driver of the train or other responsible person generates the effluent release signal in response to a visual prompt, such as a sign or signal board at an appropriate location by the track. At its simplest, the release signal generating means and valve control means may be provided by a mechanical connection between a lever and the outlet valve. The release signal could also be generated by a trackside operator who operates a release signal generating means on seeing the vehicle pass a certain point on the track.

In the preferred fully automatic system involving a release signal transmitter and a release signal detector, the release signal may be generated continuously (or with short time periodicity) and only be received by the receiver when within a pre-set detection range. Alternatively, a vehicle detector, e.g., a motion sensor or pressure sensor, may be located under or alongside the track to detect the presence or approach of a train and thereby trigger the generation of a release signal.

A suitable elongate, open-topped effluent receptacle, such as a concrete apron or concrete-lined slit-trench connected to a sewer, is preferably provided under or immediately alongside the track to collect the released effluent as it is discharged from the tank outlet, the release signal being generated so that effluent release occurs when the outlet is over the receptacle.

The outlet valve means may be adapted, e.g., by means of a latch mechanism or circuit, to remain open for a predetermined period of time after detection of a release signal. The length of time for which it is open is preferably sufficient to allow release of the contents of a full storage tank. It is therefore convenient if the vehicle operating rules specify that the vehicle must be driven over the receptacle at a predetermined maximum speed. However, if necessary, the valve opening time may be varied in response to the speed of the vehicle, for example, it may be a shorter time at higher vehicle speeds to ensure the release stops before the tank outlet has passed the end of the receptacle.

Alternatively, and preferably, the apparatus may include a "close" signal generation means adapted to generate a close signal when the vehicle reaches a further predetermined position on the track, which in turn closes the outlet valve means. This may again include a trackside transmitter interacting with a corresponding detector on the vehicle.

Conveniently, the outlet is arranged to permit the release of effluent from the tank under the influence of gravity, and may therefore comprise an opening at or near the base of the tank. The outlet valve means may be a simple electromechanically or pneumatically operated valve operable between fully closed and fully open positions and fitted across the opening or across a pipe connected to the opening. To speed up the process of emptying the tank, it may be positively pressurised, e.g., by means for supplying compressed air to the tank, to assist in the expelling of the tank contents. Such compressed air may be available from pneumatic systems installed on the vehicle, e.g., to operate brakes. Alternatively, compressed air may be provided by an electric pump associated with the tank.

By automating the release of effluent, it is possible to arrange for waste to be removed as a vehicle moves along a track across a suitable effluent receptacle. Conveniently, the effluent receptacle may be located in close proximity to a washing station for the vehicle.

In accordance with a second aspect, the invention provides a rail vehicle adapted to run on a track, the vehicle including a tank adapted to receive effluent and having an outlet, a valve means moveable between a closed position in which effluent is prevented from passing through the outlet and an open position in which effluent is allowed to pass through the outlet, and a control means for opening the release valve at a pre-determined position along the track in response to a signal generated by a release signal generation means.

There will now be described, by way of example only, embodiments of the present invention with reference to the accompanying drawing.

As diagrammatically shown in the single accompanying FIGURE, a railway vehicle, such as a passenger carriage 1, runs along a track 2 generally in the direction arrowed. An effluent receptacle, such as a concrete apron recessed below track level or a concrete-lined slit-trench 3 is provided underneath or immediately alongside a length of the track 2, and this receptacle feeds into an underground sewer 4.

The carriage 1 includes a WC 5 (or washbasin) which via a suitable pipe feeds through an inlet 6 into a storage tank 7 mounted below the carriage between the wheels. At an appropriate location on the base of the tank 7 is an outlet 8 which is normally closed by a release valve 9, opening and closing of the valve 9 being controlled by a valve controller 13.

A release signal generating means provides an effluent release signal to the valve controller 13 and in this embodiment comprises firstly a release signal transmitter 10 located alongside (or perhaps under) the track 2 at a suitable location relative to the effluent receptacle 3, and secondly a release signal detector 11 located near the front of the carriage. As the detector 11 passes the transmitter 10, it receives an electromagnetic (e.g., optical or radio) effluent release or trigger signal from transmitter 10. Upon receiving the trigger signal, the detector 11 issues an effluent release signal to the valve controller 13 (the connection between the detector 11 and the valve controller 13 is not shown, but may be by wire, optical cable or radio, for example) and the controller then strobes a latched relay which energises the electrically operated mechanical valve 9. The valve 9 opens for a pre-determined period, say 20 seconds, and thereafter the valve is closed. As the train continues to move forwards while the valve is open, the effluent in the tank 7 is released under gravity into the receptacle 3 until the tank is substantially empty.

Although other relative positions of the transmitter 10 and detector 11 may be adopted, in the particular embodiment illustrated the detector 11 is positioned at the front of the carriage 1 and the transmitter 10 is positioned part-way along the length of the receptacle 3, these positions being adjusted relative to each other such that when the detector 11 communicates the effluent release signal to the valve controller 13, the tank outlet 8 is positioned over the initial part (right-hand-side in the FIGURE) of the receptacle 3.

As will be appreciated, the adoption of a predetermined period of opening of the valve 9 means that the carriage 1 must travel forward along track 2 at a certain predefined and controlled maximum speed which is slow enough to allow emptying of the tank 7 before the left-hand end of the receptacle 3 in the FIGURE is passed by the tank outlet 8.

Alternatively, therefore, as illustrated, the detector 11 may receive a "close" signal issued by a second trackside transmitter 12 indicating the exacted point along the track at which the valve 9 is to be closed. This eliminates the need for a fixed period of valve opening, and ensures that the valve is closed when the tank outlet 8 is no longer over the receptacle 3, irrespective of the speed of the carriage along the track.

What is claimed is:

1. An effluent disposal system for a railway, comprising:

a) an effluent receptacle situated underneath or immediately alongside a length of railway track, the receptacle having walls bounding a collection chamber isolated from a roadbed on which the track lays;

b) an effluent storage tank fitted to a rail vehicle, the storage tank having an inlet for receiving effluent and an outlet for release of the effluent stored in the tank;

c) outlet valve means operable between a closed position in which the effluent is prevented from passing through the outlet, and an open position in which the effluent is allowed to pass through the outlet;

d) valve control means for controlling operation of the outlet valve means as a function of vehicle position relative to the track, the valve control means being responsive to receipt of an effluent release signal to effect opening of the outlet valve means; and e) a release signal generating means for communicating the effluent release signal to the valve control means when the vehicle is at a predetermined effluent release position with respect to the track with the outlet aligned with the collection chamber of the effluent receptacle.

2. The effluent disposal system according to claim 1, in which the outlet valve means is operative to remain in the open position for a predetermined period of time after detection of the effluent release signal.

3. The effluent disposal system according to claim 1, and further including a close signal generation means operative to generate a close signal when the vehicle reaches a further predetermined position on the track, which in turn closes the outlet valve means.

4. The effluent disposal system according to claim 3, in which the close signal generation means comprises a close signal transmitter located at a predetermined position along the track, and a close signal detector located at a predetermined position on the vehicle.

5. The effluent disposal system according to claim 1, in which the outlet is operative to permit the release of the effluent from the tank under the influence of gravity.

6. The effluent disposal system according to claim 1, further comprising means for pressurizing the tank to assist discharge of the effluent from the tank.

7. A rail vehicle adapted to run on a track, the vehicle comprising:

a) a tank for receiving effluent and having an outlet;

b) a valve means movable between a closed position in which the effluent is prevented from passing through the outlet, and an open position in which the effluent is allowed to pass through the outlet; and c) a valve control means for opening the valve means at a predetermined position along the track in response to a signal only generated by a release signal generation means at said predetermined position.

8. The rail vehicle according to claim 7, in which the valve means is operative to remain in the open position for a predetermined period of time after detection of the signal.

9. The rail vehicle according to claim 7, and further including a close signal generation means for generating a close signal when the vehicle reaches a further predetermined position on the track, which in turn closes the valve means.

10. The rail vehicle according to claim 9, in which the close signal generation means comprises a close signal detector located at a predetermined position on the vehicle, the close signal detector being operative to receive a close signal transmitted from a transmitter located at a predetermined position along the track.

11. The rail vehicle according to claim 7, in which the tank outlet is operative to permit the release of the effluent from the tank under the influence of gravity.

12. The rail vehicle according to claim 7, and further comprising means for pressurizing the tank to assist discharge of the effluent from the tank.

13. An effluent disposal system for a railway, comprising:

a) an effluent receptacle situated underneath or immediately alongside a length of railway track;

b) an effluent storage tank fitted to a rail vehicle, the storage tank having an inlet for receiving effluent and an outlet for release of the effluent stored in the tank;

c) outlet valve means operable between a closed position in which the effluent is prevented from passing through the outlet, and an open position in which the effluent is allowed to pass through the outlet;

d) valve control means for controlling operation of the outlet valve means, the valve control means being responsive to receipt of an effluent release signal to effect opening of the outlet valve means; and e) a release signal generating means for communicating the effluent release signal to the valve control means when the vehicle is at a predetermined effluent release position with respect to the effluent receptacle, the release signal generating means comprising a release signal transmitter located at a predetermined position along the track, and a release signal detector located at a predetermined position on the vehicle.

14. The effluent disposal system according to claim 13, in which the release signal transmitter is a transmitter of electromagnetic radiation, and in which the release signal detector is a detector of the electromagnetic radiation emitted by the transmitter.

15. The effluent disposal system according to claim 14, which the release signal transmitter is operative to transmit a coded signal, and in which one of the release signal detector and the valve control means is operative to decode the coded signal.

16. A rail vehicle adapted to run on a track, the vehicle comprising:

a) a tank for receiving effluent and having an outlet;

b) a valve means movable between a closed position in which the effluent is prevented from passing through the outlet, and an open position in which the effluent is allowed to pass through the outlet; and c) a valve control means for opening the valve means at a predetermined position along the track in response to a signal generated by a release signal generation means, the release signal generating means comprising a release signal detector located at a predetermined position on the vehicle, the release signal detector being operative to receive a release signal transmitted from a transmitter located at a predetermined position along the track.

17. The rail vehicle according to claim 16, in which the release signal detector is a detector of electromagnetic radiation emitted by the transmitter.

18. The rail vehicle according to claim 17, in which one of the release signal detector and the valve control means is operative to decode a coded signal emitted by the release signal transmitter.

* * * * *